US011337506B1

(12) United States Patent
Pham et al.

(10) Patent No.: US 11,337,506 B1
(45) Date of Patent: May 24, 2022

(54) NAIL POLISH BOTTLE

(71) Applicants: Ben Thai Pham, Lawrenceville, GA (US); Kristy Tran, Lawrenceville, GA (US)

(72) Inventors: Ben Thai Pham, Lawrenceville, GA (US); Kristy Tran, Lawrenceville, GA (US)

( * ) Notice: Subject to any disclaimer, the term of this patent is extended or adjusted under 35 U.S.C. 154(b) by 0 days.

(21) Appl. No.: 17/394,774

(22) Filed: Aug. 5, 2021

(51) Int. Cl.
*A45D 34/04* (2006.01)

(52) U.S. Cl.
CPC ..... *A45D 34/045* (2013.01)

(58) Field of Classification Search
CPC .... A45D 34/04; A45D 34/046; A45D 34/045; A45D 34/042; A45D 34/043; A45D 34/047; A45D 34/048; A45D 40/24; A45D 29/18; A45D 29/11; A45D 29/12; A45D 2200/25; A45D 2029/005; B65D 1/04
USPC ..... 132/314, 73; 401/129, 18; 206/504, 485, 206/489, 545, 546; 220/772
See application file for complete search history.

(56) References Cited

U.S. PATENT DOCUMENTS

D133,988 S * 10/1942 Richards ..... 132/73
2,721,561 A * 10/1955 Dyche ..... A45D 40/24 401/129
3,480,371 A * 11/1969 Lee ..... B43M 99/006 401/121
4,600,328 A * 7/1986 Clements ..... A45D 40/24 132/218
4,784,505 A * 11/1988 Dahm ..... A45D 34/046 401/122
D300,269 S * 3/1989 Cassai ..... 401/126
D307,952 S * 5/1990 Cassai ..... D28/77
5,655,554 A * 8/1997 Goldberg ..... A45D 34/06 132/314
8,523,473 B2 * 9/2013 Kim ..... A45D 34/045 401/126
2002/0094224 A1 * 7/2002 Kaufman ..... A45D 34/045 401/16
2003/0185616 A1 * 10/2003 Dumler ..... A46B 5/0016 401/17
2004/0096261 A1 * 5/2004 Gueret ..... A46B 9/021 401/129
2005/0084318 A1 * 4/2005 Bland ..... A45D 40/00 401/17
2008/0283077 A1 * 11/2008 Gueret ..... A45D 40/24 132/218
2010/0242981 A1 * 9/2010 Bouix ..... A45D 40/265 132/202

(Continued)

*Primary Examiner* — Cris L. Rodriguez
*Assistant Examiner* — Brianne E Kalach
(74) *Attorney, Agent, or Firm* — Christopher Pilling

(57) ABSTRACT

An improved nail polish bottle includes a receptacle having an inner volume configured to retain a nail polish substance. The receptacle having two openings with a pair of coupling members attached to the two openings. The pair of coupling members configured to couple two nail polish cap and brush assemblies. Each nail polish cap and brush assembly includes a different brush type. One is a standard brush for general nail polish use and the other is detailed brush for fine detailed work, such as nail art. The caps on the assemblies may include different shapes or designs so the user knows which cap corresponds to a specific brush. Both brush types share the same nail polish substance in the inner volume of the receptacle.

2 Claims, 3 Drawing Sheets

(56) References Cited

U.S. PATENT DOCUMENTS

| | | | | |
|---|---|---|---|---|
| 2011/0020047 | A1* | 1/2011 | Kim | A46B 11/00 401/35 |
| 2011/0103872 | A1* | 5/2011 | Choi | A45D 40/24 401/34 |
| 2013/0087163 | A1* | 4/2013 | Lampugnale | A45D 34/06 132/75 |
| 2014/0326265 | A1* | 11/2014 | Golding | A45D 40/26 132/200 |
| 2016/0166044 | A1* | 6/2016 | Caulier | A45D 34/045 401/128 |

* cited by examiner

NAIL POLISH BOTTLE

CROSS-REFERENCE TO RELATED APPLICATIONS

N/A

BACKGROUND OF THE INVENTION

1. Field of the Invention

The present invention relates to nail polish bottles but more particularly to a nail polish bottle coupled with multiple brushes.

2. Description of Related Art

Nail polish, including liquids, lacquers, and gels are used as an application to a user's fingernails or toenails for decoration and protection of the user's nail plates. The polish can come in a variety of colors, shines, coats, and glitters. Nail polish bottles include a single brush enabling the applying of the polish.

BRIEF SUMMARY OF THE INVENTION

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

In one aspect of the invention an a nail polish bottle is provided, comprising a receptacle having an inner volume configured to retain a nail polish substance; a first opening and a second opening position on a top portion of the receptacle, the first opening and the second opening including a first protruding coupling member and a second protruding coupling member respectively; and, a first nail polish cap and brush assembly having a first bristle brush configured to be removably coupled with the first protruding coupling member; and, a second nail polish cap and brush assembly having a second bristle brush configured to be removably coupled with the second protruding coupling member.

In one embodiment, the first bristle brush is different than the second bristle brush. In one another embodiment, the second bristle bush is thinner than the first bristle brush. In yet another embodiment, the first bristle brush is a standard wide bristle brush and the second bristle brush is a detailing brush. In one embodiment, the first protruding coupling member and the second protruding coupling member is threaded. In one embodiment, the first nail polish cap and brush assembly includes a first cap and the second nail polish cap and brush assembly includes a second cap, wherein the first cap is different in appearance to the second cap. In another embodiment, the first bristle brush is at least 2 mm wide. In yet another embodiment, the second bristle brush is less than 1 mm wide.

In another aspect of the invention, a nail polish bottle is provided, comprising a receptacle having an inner volume configured to retain a nail polish substance; a first opening and a second opening positioned on the receptacle, the first opening and the second opening including a first protruding coupling member and a second protruding coupling member respectively; and, a first nail polish cap and brush assembly having a standard bristle brush configured to be removably coupled with the first protruding coupling member, wherein the standard bristle brush is configured to apply the nail polish substance on an entire nail plate of a user; and, a second nail polish cap and brush assembly having a detailing bristle brush configured to be removably coupled with the second protruding coupling member, wherein the detailing bristle brush is configured to apply the nail polish substance in a design or artwork that does not cover the entire nail plate of the user.

In one embodiment, the first nail polish cap and brush assembly includes a first cap and the second nail polish cap and brush assembly includes a second cap, wherein the first cap is different in appearance to the second cap. In one embodiment, the standard bristle brush is at least 2 mm wide. In one embodiment, the detailing bristle brush is less than 1 mm wide.

The foregoing has outlined rather broadly the more pertinent and important features of the present disclosure so that the detailed description of the invention that follows may be better understood and so that the present contribution to the art can be more fully appreciated. Additional features of the invention will be described hereinafter which form the subject of the claims of the invention. It should be appreciated by those skilled in the art that the conception and the disclosed specific methods and structures may be readily utilized as a basis for modifying or designing other structures for carrying out the same purposes of the present disclosure. It should be realized by those skilled in the art that such equivalent structures do not depart from the spirit and scope of the invention as set forth in the appended claims.

BRIEF DESCRIPTION OF THE SEVERAL VIEWS OF THE DRAWINGS

Other features and advantages of the present invention will become apparent when the following detailed description is read in conjunction with the accompanying drawings, in which.

DETAILED DESCRIPTION OF THE PREFERRED EMBODIMENT

The following description is provided to enable any person skilled in the art to make and use the invention and sets forth the best modes contemplated by the inventor of carrying out his invention. Various modifications, however, will remain readily apparent to those skilled in the art, since the general principles of the present invention have been defined herein to specifically provide a nail polish bottle.

It is to be understood that the terminology used herein is for the purpose of describing particular embodiments only and is not intended to be limiting. The terms "a" or "an," as used herein, are defined as to mean "at least one". The term "plurality," as used herein, is defined as two or more. The term "another," as used herein, is defined as at least a second or more. The terms "including" and/or "having," as used herein, are defined as comprising (i.e., open language). The term "coupled," as used herein, is defined as connected, although not necessarily directly, not necessarily mechanically, and not permanent. The term "providing" is defined herein in its broadest sense, e.g., bringing/coming into physical existence, making available, and/or supplying to someone or something, in whole or in multiple parts at once or over a period of time. As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure.

Figure 1:
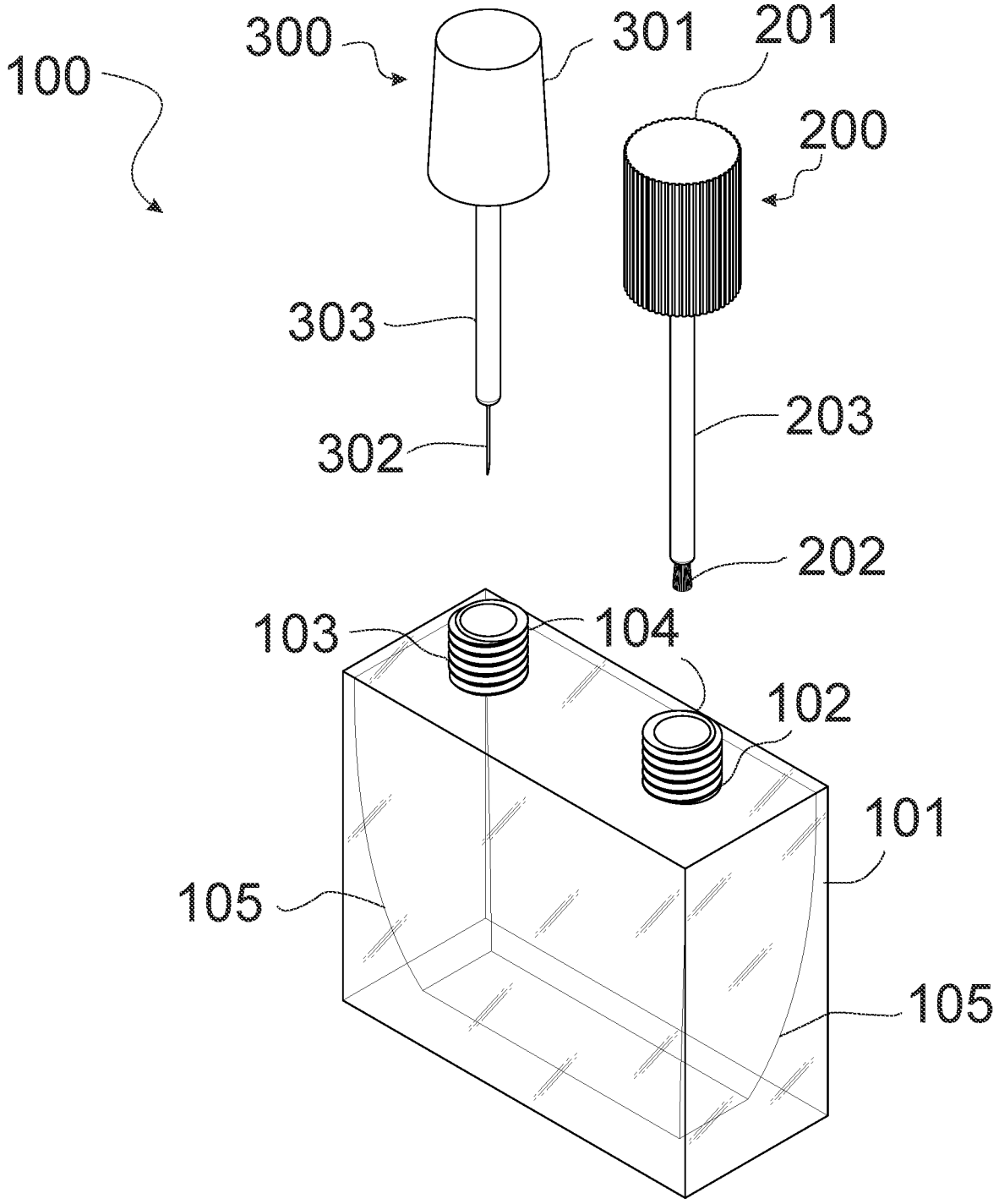
FIG. 1 is a perspective view of the nail polish bottle with both brushes extracted from the bottle according to an embodiment of the present invention.
Figure 2:
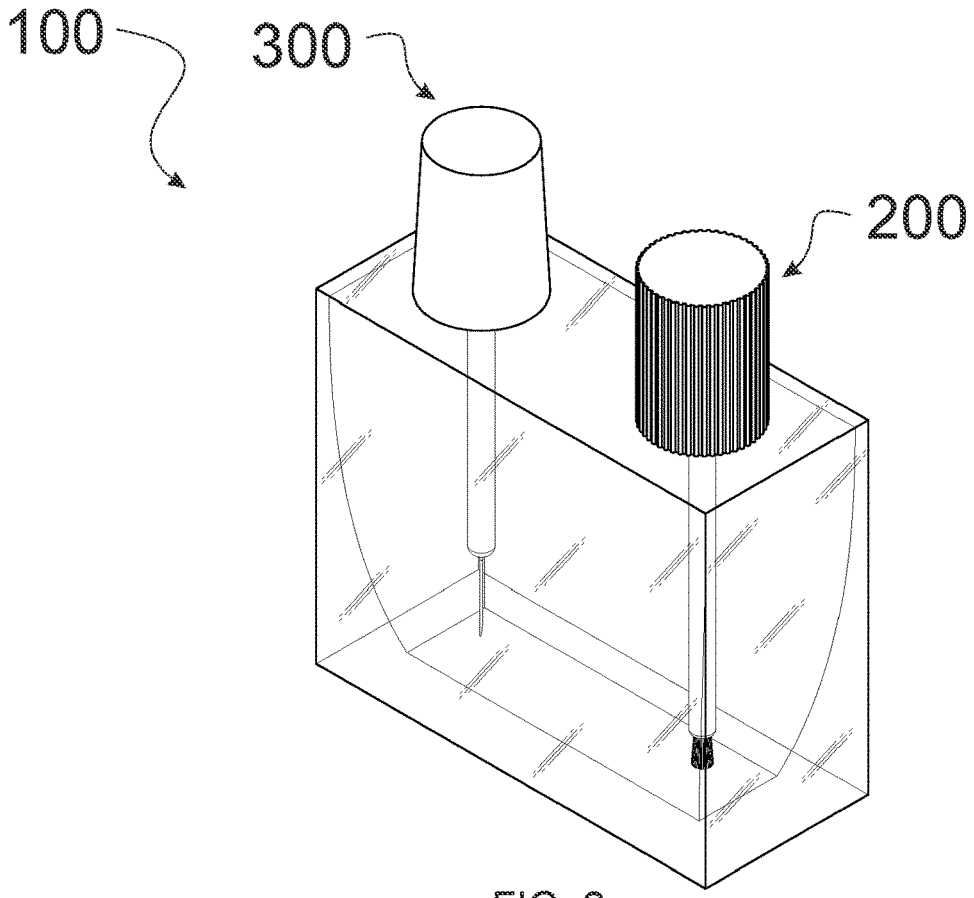
FIG. 2 is a perspective view of the nail polish bottle with both brushes positioned in the bottle according to an embodiment of the present invention.
Figure 3:
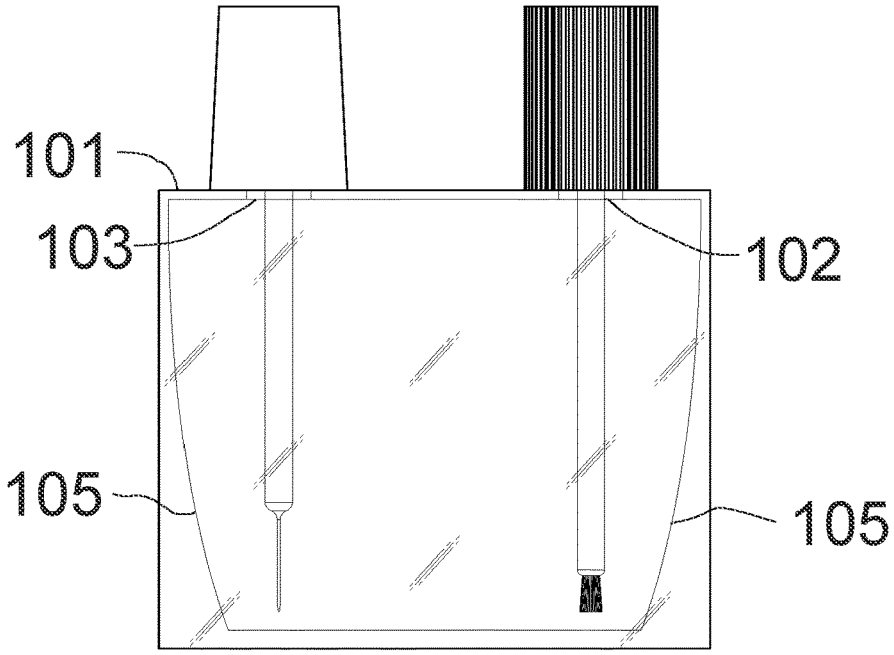
FIG. 3 is a front view of the nail polish bottle with both brushes positioned in the bottle according to an embodiment of the present invention.
Figure 4:
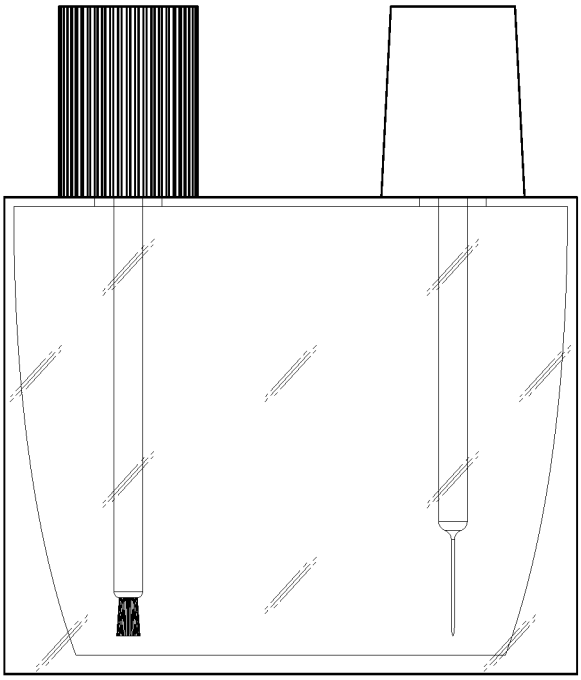
FIG. 4 is a rear view of the nail polish bottle with both brushes positioned in the bottle according to an embodiment of the present invention.
Figure 7:
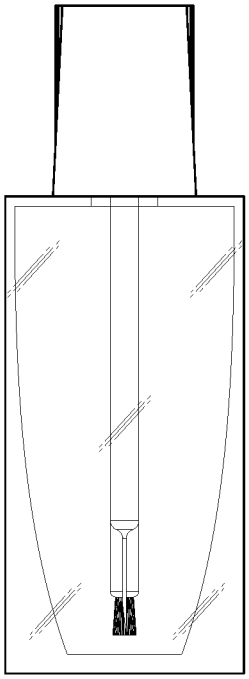
FIG. 7 is a left side view of the nail polish bottle with both brushes positioned in the bottle according to an embodiment of the present invention.
Figure 5:
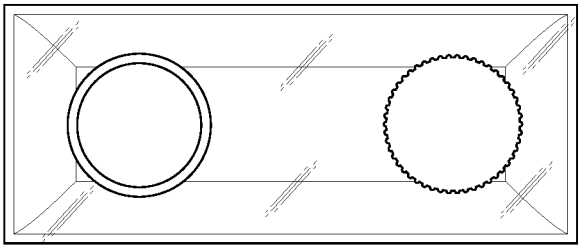
FIG. 5 is a top view of the nail polish bottle with both brushes positioned in the bottle according to an embodiment of the present invention.
Figure 6:
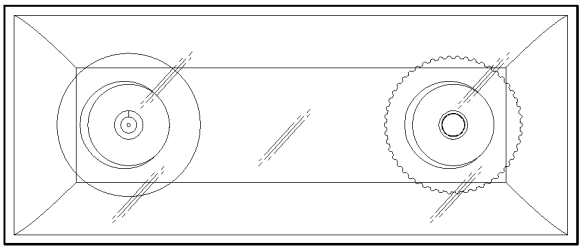
FIG. 6 is a bottom view of the nail polish bottle with both brushes positioned in the bottle according to an embodiment of the present invention.
Figure 8:
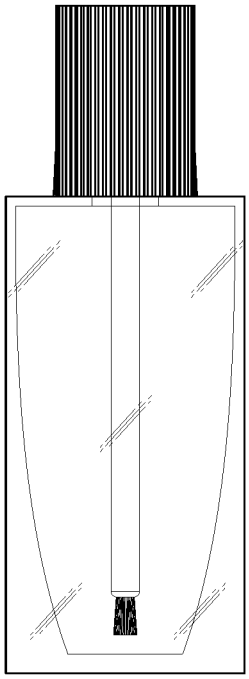
FIG. 8 is a right side view of the nail polish bottle with both brushes positioned in the bottle according to an embodiment of the present invention.

Referring now to FIGS. 1-8, the nail polish bottle 100 is illustrated. In one embodiment, the nail polish bottle 100 comprises a receptacle 101 having a rectangular shape configured to hold nail polish, gel, lacquer, varnish, or any other nail polish like substance of a color, which may vary as well known in the art. In other embodiments, other receptacle shapes may be provided, including but not limited to, square, circular, oval, conic, dome, cylindrical, triangular, star, diamond, polygons, and irregular polygons including shapes to represent objects, such as objects, flowers, hearts, animals, insects, and people. It should be apparent that the functionality of the invention can easily be applied to any shape mentioned above, and the present invention should not be limited to the rectangular shape illustrated. The illustrated shape was merely provided as an example for simplicity to clearly show the invention.

In one embodiment, the receptacle 101 comprises a first opening 102 and a second opening 103 on a top portion of the receptacle 106, wherein each opening provides access to the internal volume of the receptacle 101. In one embodiment, the receptacle is clear such that the inner or internal volume of the receptacle is visible. In one embodiment, each opening includes a coupling protrusion 104 configured to enable a nail polish cap and brush assembly 200/300 to attach to the receptacle 100. In one embodiment, the coupling protrusion 104 is a threaded member, wherein the nail polish cap 201/301 includes internal matching threads (not shown) can be threaded on the coupling protrusion 104. Although a treaded connection is illustrated, other coupling connections may be provided, including a snap fit, tolerance fit, press fit, magnetic connections, or any other known connections. Advantageously, the coupling protrusion 104 enables the nail polish cap and brush assembly 200/300 to either attach or to rest approximate to the coupling protrusion such that the brush bristles 202/302 via the brush stem 203/303 may be reinserted into the interior volume of the receptacle 101 such that nail polish, gel, etc. may be accumulated on the brush bristles 202/302 for use as well known in the art.

In one embodiment, the first brush bristles 202 on the first nail polish cap and brush assembly 200 is a wide brush configured to paint the entire nail plate of the user. This is a general brush for general use as well known in the art. In one embodiment, the bristles of the first brush bristles 202 are between 4 and 8 mm. In other embodiments, the bristles of the first brush bristles are at least 2 mm or larger. The second brush bristles 302 is a thin detailing brush configured for design, and intricate artwork. The type of detailing brush may vary, as long as the detailing brush is intended for detailed art design work or other art type patterns, such as striping brush, angled brush, flat brush, round brush, fan brush, dotter brush, or liner brush. In some embodiments, the detailing brush is much thinner than the standard brush. In one embodiment, the detailing brush is less than 1 mm in thickness. In one embodiment, the detail brush has a size of 0, 00, 000, and 0000 in standard nail brush sizes which also may be referred to as 0, 2/0, 3/0, and 4/0 respectively. In one embodiment, the bristles of the first brush bristles are configured to paint or polish the entire nail of a user. Generally known as applying a base color to the nail, wherein the bristles of the second brush bristles are configured to paint artwork on a portion of the nail. Thus, the bristles of the second brush bristles are not configured to be applied or to paint/polish the entire nail. In simplest forms, the first and second brushes are for different proposes which can be defined as general use for standard nail painting, and fine detailed work respectively.

Advantageously, having a standard, general brush and a detailing brush in a single receptacle has several advantages. First, it doesn't require the user to purchase two single nail polish bottles of each brush type of the same color with different brushes. Second, it allows both brush bristles 202/302 to be submerged in the nail polish, gel, etc. contained within the receptacle 101 which prevents the brushes from drying out if they exposed to air after use, a common problem with standalone brushes.

Each nail polish cap 201/301 may be of a different design, including but not limited to shape, color, texture, insignia, and text to notify the user which nail polish cap contains the specific brush type, i.e. standard brush or detailing brush. For instance, in the illustrated example through the drawings FIG. 1-8, the standard brush cap 201 includes a cylindrical shape containing ridges and the detailing brush cap 301 includes a basic conic shape with a flat top. It should be understood that the designs may vary.

In some embodiments, the inner surface of the receptacle may include angled surfaces 105 to direct the nail polish, gel, etc. towards the center portion of the inner volume such that the nail polish may be applied to the brush bristles during use. This is especially useful when the nail polish is running low and prevents the nail polish from building up in the corners of the receptacle.

Although the invention has been described in considerable detail in language specific to structural features, it is to be understood that the invention defined in the appended claims is not necessarily limited to the specific features described. Rather, the specific features are disclosed as exemplary preferred forms of implementing the claimed invention. Stated otherwise, it is to be understood that the phraseology and terminology employed herein, as well as the abstract, are for the purpose of description and should not be regarded as limiting. Therefore, while exemplary illustrative embodiments of the invention have been described, numerous variations and alternative embodiments will occur to those skilled in the art. Such variations and alternate embodiments are contemplated, and can be made without departing from the spirit and scope of the invention. For instance, in some embodiments more than two nail polish cap and brush assemblies may be provided.

It should further be noted that throughout the entire disclosure, the labels such as left, right, front, back, top, bottom, forward, reverse, clockwise, counter clockwise, up, down, or other similar terms such as upper, lower, aft, fore, vertical, horizontal, oblique, proximal, distal, parallel, perpendicular, transverse, longitudinal, etc. have been used for convenience purposes only and are not intended to imply any particular fixed direction or orientation. Instead, they are used to reflect relative locations and/or directions/orientations between various portions of an object.

In addition, reference to "first," "second," "third," and etc. members throughout the disclosure (and in particular, claims) are not used to show a serial or numerical limitation but instead are used to distinguish or identify the various members of the group.

What is claimed is:

1. A nail polish bottle comprising:

a receptacle; and first and second assemblies, the receptacle comprising: a top surface and a flat bottom surface configured to rest on a flat surface, and the receptacle defining a single inner volume configured to retain a nail polish substance; and a first opening and a second opening, each positioned on the top surface of the receptacle and opening into the single inner volume, the first opening and the second opening each defining a first protruding coupling member and a second protruding coupling member respectively;

the receptacle configured to simultaneously receive each of the first and second assemblies, each of the first and second assemblies comprising a respective cap configured to be gripped by a user and removably coupled with a corresponding one of the first and second protruding coupling members;

the first assembly comprising a nail polishing bristle brush having a first size and shape configured to apply nail polish substance contained within the inner volume to a user, the second assembly comprising a detailing brush configured to apply the same nail polish substance contained within the inner volume to a user in a manner if detailing, design, or other patterns that are not painting the entire nail, wherein the size and shape of the bristle brush is different from the size and shape of the detailing brush; and, the first cap has a corresponding different shape and texture from the second cap.

2. The nail polish bottle of claim 1, wherein the first protruding coupling member and the second protruding coupling member is threaded.

* * * * *